United States Patent [19]

Wingrave

[11] Patent Number: 4,852,400

[45] Date of Patent: Aug. 1, 1989

[54] METHOD AND APPARATUS FOR DETERMINING PHYSICAL INTEGRITY OF GEOLOGICAL STRATA

[75] Inventor: James A. Wingrave, Chadds Ford, Pa.

[73] Assignee: E. I. Du Pont De Nemours and Company, Wilmington, Del.

[21] Appl. No.: 300,240

[22] Filed: Jan. 23, 1989

Related U.S. Application Data

[63] Continuation-in-part of Ser. No. 161,549, Feb. 29, 1988, abandoned.

[51] Int. Cl.[4] ..... E21B 49/00

[52] U.S. Cl. ..... 73/153; 73/866

[58] Field of Search ..... 73/151, 152, 153, 866, 73/59

[56] References Cited

U.S. PATENT DOCUMENTS

| | | | |
|---|---|---|---|
| 2,963,642 | 12/1960 | Arbogast et al. | 73/153 |
| 3,646,997 | 3/1972 | Chenevert | 166/250 |
| 3,791,222 | 2/1974 | Goodhart et al. | 73/866 |
| 3,802,272 | 4/1974 | Bischoff et al. | 73/866 |
| 4,359,901 | 11/1982 | Bates et al. | 73/153 |

OTHER PUBLICATIONS

G. m .Bol, "The Effect of Various Polymers and Salts on Boreholes and Cutting Stability in Water-Base Shale Drilling Fluids", Paper Presented at the 1986 IADC/SPE Drilling Conference, Dallas, Texas, Feb. 10-12, 1986.

*Primary Examiner*—Stewart J. Levy
*Assistant Examiner*—Kevin D. O'Shea
*Attorney, Agent, or Firm*—Charles E. Krukiel

[57] ABSTRACT

A method and apparatus for determining the physical integrity of geological shales and for simulating the environment experienced by geological strata comprising forming a test specimen of the stratum to be measured; immersing the specimen in a drilling fluid, or a mixture of drilling fluids, for a predetermined length of time; spinning the test specimen while immersed up to a predetermined speed while adjusting the temperature of the fluid; and then physically measuring the specimen for disintegration, liquid absorption, and hardness. The apparatus for simulating the environment experienced by geological strata includes means for immersing the specimen in the drilling fluid which comprises a nail having the specimen attached to the shank adjacent the head to hold the specimen inverted below the surface of the drilling fluid.

12 Claims, 2 Drawing Sheets

METHOD AND APPARATUS FOR DETERMINING PHYSICAL INTEGRITY OF GEOLOGICAL STRATA

This application is a continuation-in-part of Ser. No. 161,549, filed Feb. 29, 1988, now abandoned.

BACKGROUND OF THE INVENTION

The present invention relates to a method and apparatus for determining the physical integrity of certain geological strata, and, more particularly, to an improved method and apparatus for determining the ability of certain chemical moieties to stabilize geological strata comprising shale by simulating the environment experienced by such stratum and quantatively measuring its physical integrity after exposure to such moieties.

In the exploration for oil and gas, and in the drilling of wells generally, drilling operators use a variety of drilling fluids, or drilling muds, to assist in the drilling process. These muds, which are normally commercial formulations, are selected depending on the geological conditions in the borehole for their ability to stabilize the borehole wall, reduce friction between the borehole wall and the drill pipe, and/or to lift cuttings from the bottom of the borehole. Typical drilling muds have been formulations comprising refined oils and other additives, but oil muds can interfere with well logging procedures and can produce adverse environmental effects if not properly handled. Consequently, drilling operators shifted toward aqueous based drilling muds. However, geological strata, such as certain uncemented or young shales, can lose physical integrity when exposed to aqueous drilling fluids, and this can adversely effect drilling operations. To overcome this problem, research was begun to determine which chemical moieties would be most effective at inducing physical integrity in geological shales and to develop aqueous drilling muds containing those moieties.

Some of the test procedures used to evaluate shales are described in "The Effect of Various Polymers and Salts on Borehole and Cutting Stability in Water-Base Shale Drilling Fluids" by G. M. Bol, Koninklijke/Shell E & P Laboratorium, a paper presented at the 1986 IADC/SPE Drilling Conference held in Dallas, Tex., Feb. 10–12, 1986. These tests aid the geologist in determining swelling, erosion and disintegration properties of shales. As can be seen from the schematic representations and the discussion, tests of this kind can require expensive specialized equipment and can be quite time consuming. U.S. Pat. No. 3,646,997 describes a procedure for determining compatibility of a well fluid with a subterranean shale by determining the direction and extent of water migration (due to absorption or desorption within the shale) between the drilling fluid and the shale.

U.S. Pat. No. 4,359,901 describes a method for measuring the chemical swelling effect of a fluid on a shale-containing subterranean earth formation.

A quicker, more easily accomplished bench-scale test is required which will simulate the environment experienced by geological strata during the drilling of a well so that the physical integrity of the strata can be measured quantitatively immediately after exposure to a drilling fluid. This can now be done under controlled physical conditions, including liquid shear, temperature and static pressure.

SUMMARY OF THE INVENTION

The present invention is a convenient, relatively quick and easily accomplished method for simulating the environment experienced by geological strata, particularly shales, during drilling and quantatively measuring the physical integrity of the strata after exposure to a drilling liquid, or a mixture of drilling liquids. The method comprises the steps of:

(a) forming a test specimen of the stratum to be measured;

(b) immersing the specimen in the drilling liquid, or mixture of liquids, for a predetermined length of time;

(c) spinning the test specimen while immersed up to a predetermined speed while adjusting the temperature in a predetermined timed sequence; and (d) physically measuring the specimen for disintegration, liquid absorption, and hardness.

This invention also relates to a bench-scale apparatus which can easily simulate the environment experienced by geological shale during drilling operations regardless of the depth of the drill bit. The apparatus comprises:

(a) a cup for holding a drilling liquid;

(b) a liquid bath surrounding said cup for indirectly heating or cooling said drilling liquid;

(c) means for immersing a specimen in said drilling liquid; and (d) means for spinning said specimen at a predetermined speed while it is immersed.

The method and apparatus of this invention allows an investigator to develop and maintain constant test conditions for the specimens being tested. Quantitative measurements can be taken for each test specimen which will indicate its disintegration and swelling tendencies as well as its hardness immediately following exposure to a drilling fluid. Using this information, which can be developed at the drill site if desired, an investigator can determine which drilling mud chemicals will induce the desired physical integrity of the geological shale being drilled.

DETAILED DESCRIPTION OF THE INVENTION

Figure 1:
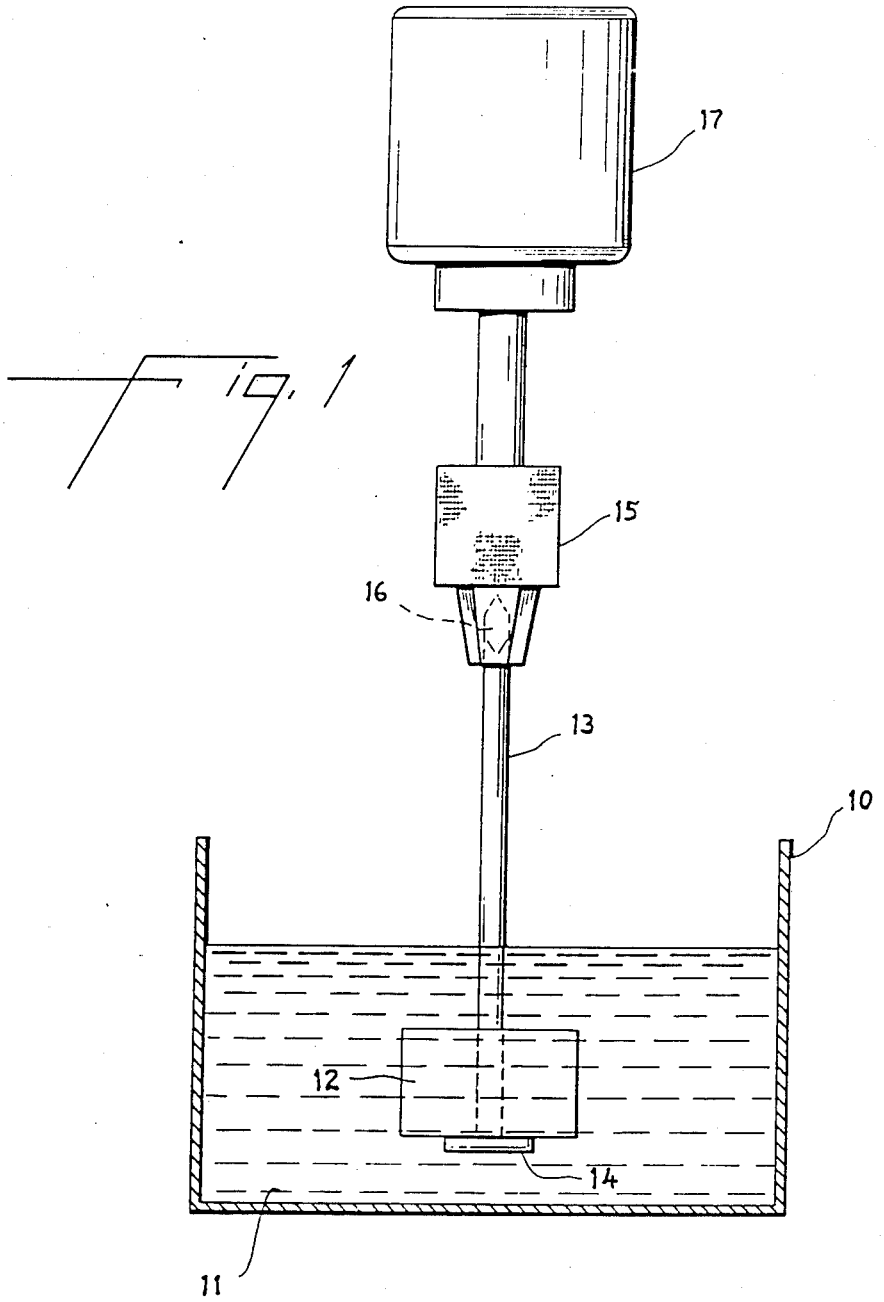
FIG. 1 is a schematic diagram, in partial section, of an apparatus according to this invention.
Figure 2:
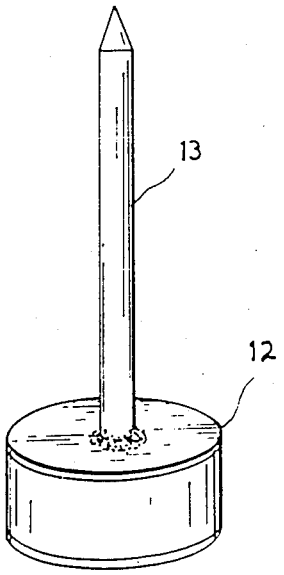
FIG. 2 is a perspective view of a test specimen which can be used in the method of this invention.

Shown in FIG. 1 is a schematic diagram of the test apparatus of this invention. A beaker or cup 10 of suitable size, such as a typical laboratory glass beaker, can be used to hold the drilling fluid 11 for the evaluation. Normally, a beaker of about 50 ml filled to 40 ml is satisfactory. The test specimen 12 is compressed about the shank of a common nail 13, preferably a 4D common nail, adjacent the nail head 14, as shown. More than one test apparatus can be used simultaneously, depending on the number of specimens to be tested. A chuck 15 is arranged to hold the pointed end 16 of the nail such that the nail is inverted during the test with the specimen being immersed. The chuck 15 is mounted on the shaft of a motor 17 having a speed controllable at about 1500 revolutions per minute (rpm). Referring now to FIG. 2, the test specimen 12 is preferably in the shape of a pellet or cylinder. The specimen, for convenience and because of an emphasis on reproducibility of results, is formed from reconstituted shale samples. Each sample shale is first ground into a fine powder and then sieved through a 200 mesh screen. Each test specimen is prepared by thoroughly mixing 2.00 g±0.005 g, on a dry basis, (designated hereinafter Ms) of the shale powder (−200 mesh) with 0.30 g of deionized water (or multiples thereof for multiple specimens). The shale/water mix is then compressed into a pellet around the shank of a 4D common nail 13 adjacent the nail head 14. In practice, a steel die is used which has a cross sectional area of 0.2 square inches (1.29 square cm). The nail is placed in the die first in a vertical position with the head down. A washer 18, preferably a 10L brass washer, is then placed over the nail shank so that it rests against the nail head. The shale/water mix is then charged to the die, and compression is commenced. The punch, i.e., the smaller member that pushes the specimen powder into the die cavity, has a central opening to accommodate the shank of the nail during compression. The die and punch are placed into a hydraulic press, taking care not to spill any of the shale/water mix, and a compressive force of 1000 lbs (453.6 kg) is applied for 2 minutes to form the test pellet. The compressive force, equivalent to 5000 psig ($3.5\times10^5$ g/cm$^2$), was selected in an attempt to reproduce as nearly as possible the steps under which the shale was originally formed. Geostrata pressure varies at about 1 psig/ft (230 g/cm$^2$/m), and 5000 psig is equivalent to the pressure at the bottom of a 5000 ft (1525 m) well. Higher or lower pressures can be used depending on the subsurface pressure to be simulated. When the pellet is removed from the die, now firmly affixed about the nail shank, a second, identical washer **18*a* is then placed over the nail shank in contact with the upper surface of the pellet. The second washer is held in place as shown in FIG. 2 using common epoxy resin 19** or other suitable glue, such as, for example, K-Poxy (McKim Group, Waltham, MA) or 5 Minute Epoxy (True Value Hardware Stores). The washers are employed to limit the surface of the shale pellet which is exposed to fluid shear stress. Thus, a model is created where the shear stress imparted by the fluid is controlled on one surface only.

It is important that all test specimens begin the test at the same moisture condition. The specimens, therefore, are humidity-conditioned by placing them in a controlled humidity environment until they reach a constant weight (Mi). This can be accomplished conveniently by maintaining the specimens in a laboratory dessicator at a value in the range of 30% to 90% relative humidity during a period of about 48 hours. Preferably, the specimens are maintained at 84% relative humidity for humidity-conditioning. Those familiar with geological strata and drilling conditions will appreciate that the time period for humidity-conditioning can vary depending on the composition of the specimen shale. For convenience, the specimens can be held in the dessicator until test equipment is available to begin the evaluation. The evaluation is begun by immersing the specimen in the drilling fluid which has been selected for the test. As previously stated, the drilling fluid is held in a 50 ml beaker filled to 40 ml. The beaker is large enough, relative to the size of the specimen, that there will be no significant shear stresses induced on the pellet by the beaker sidewalls during the spinning procedure. The beakers can be glass or other material, but plastic is preferred. The specimen is soaked overnight for a period ranging from 16 to 20 hours. The soaking step allows the fluid to be imbibed by the shale until a state of saturation is reached. Immediately following the soaking step, the specimen undergoes a spinning/heating cycle during which the tendency of the fluid to disintegrate the strata (designated DI), swell the strata (designated SI), and soften the strata (designated HI) can be recorded.

In practice, the pointed end of the nail 16 holding the specimen is secured in a chuck 15 mounted on the shaft of a motor 17 whose rotational speed is controllable at 1500 rpm. The motor is arranged so that the test specimen can be spun for one hour at the desired speed while being held below the surface of the drilling fluid in the beaker. Neglecting end effects, the shear stress exerted on the cylindrical surface of the spinning pellet is everywhere constant, and the top and bottom washers protect the circular surfaces of the pellet from deterioration due to shear. Spinning the pellet at 1500 rpm creates a linear velocity at its cylindrical surface of 200 ft/min (60 m/min). This velocity is typical of fluid velocities occurring in a wellbore, and the erosive stress being exerted on the shale specimen simulates the shear stress which occurs on the wall of a borehole. Other rotational speeds can also be used to evaluate the effects of other linear velocities.

During the spinning cycle, which covers one hour, the temperature of the drilling fluid is raised and lowered using a water bath surrounding the beaker according to the following cycle:

(1) 15 minutes at room temperature,
(2) 30 minutes at 80° C., and
(3) 15 minutes at room temperature.

By varying the temperature according to the foregoing cycle, it is possible to simulate the heating/cooling cycle a drilling fluid experiences under field conditions in circulating from the mud pit (room temperature) to the bottom of the borehole (80° C., or any other desired bottom hole temperature) and back to the mud pit (room temperature). The time sequence and bottom hole temperature can be adjusted to conveniently simulate any drilling scenario a drilling fluid might experience and determine the effect that fluid will have on a particular stratum of shale being drilled.

Immediately following completion of the spinning cycle, the test specimen is removed from the beaker and wiped with an absorbent paper tissue to remove excess fluid from its surface so that when weighed, only the fluid which has been absorbed into the pellet plus the pellet itself will be weighed. This weight is designated Mw, and in this way only the fluid that has swollen the pellet will be included in the SI parameter.

The specimen is then humidity-conditioned at a relative humidity of 84% until a constant weight is again achieved (Mf).

It is sufficient if each sample is weighed periodically until two weights are within 0.05% of one another. This will signify that the specimens are at an equilibrium again, and the end weights will have a statistical significance relative to their original weights.

The weights Mi, Mw, and Mf, along with the initial shale weight, Ms, are measured to the nearest milligram using a laboratory balance. Using the following formulas a Disintegration Index (DI) and a Swelling Index (SI) can be computed for the test specimen.

$$DI = \frac{\text{Weight Loss (g)}}{\text{Initial Weight (g)}} = \frac{Mi - Mf}{Ms}$$

-continued $$SI = \frac{\text{Fluid Absorbed}}{\text{Final Specimen Wt}} = \frac{Mw - Mf}{Ms - (Mi - Mf)}$$

The Disintegration Index, DI, is a measure of the dispersion or sloughing tendency of a shale/fluid combination. DI can range in value from 0 (no loss of shale) to 1 (complete loss of the specimen). As long as the test conditions are held constant, the values obtained for DI will be significant in providing the investigator with a means for comparing the dispersion, or sloughing, tendencies for different shale/fluid combinations.

The Swelling Index, SI, provides a quantitative measure of the fluid uptake character of the shale being evaluated. It represents the fractional weight gain by a pellet during testing with concomitant swelling: 0=no swelling or fluid absorption, and a value of 1=absorption of 2 g of fluid.

A third measurement is taken to determine the specimen's Durometer A Hardness Index (HI), i.e., the hardness of the pellet after testing as measured with a Durometer A Penetrometer (Model No. 306L, PTC Instruments, Pacific Transducer Corp.). The value can be determined simply by rotating the specimen surface against the probe pin of the penetrometer. The HI value provides a quantitative measure of the hardness retention of a shale specimen after it has been exposed to the test fluid under the conditions selected for the test.

Occasionally, a dilling fluid being evaluated may contain non-volatile liquid components, such as, for example, water soluble polymers, oils, and the like, which will not evaporate from the test specimen during the humidity-conditioning step which follows spinning of the specimen. In such a case, an additional retorting step may be necessary to remove the non-volatile components from the specimen prior to humidity-conditioning.

Figure 3:
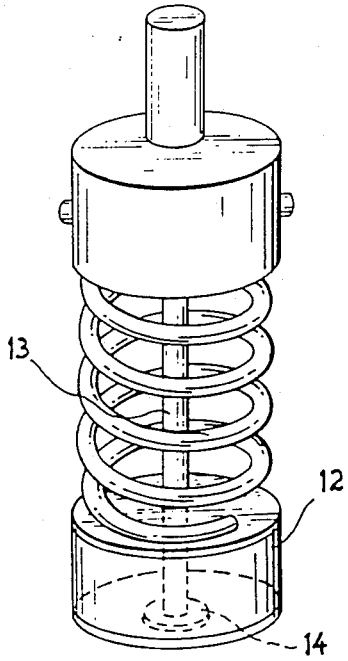
FIG. 3 is a perspective view of a test specimen including a spring for maintaining pressure on the specimen during the test method of this invention.

Referring now to FIG. 3, a further aspect of this invention can be seen. A spring 20 is provided with a spring retainer 21 and set screws 22 to hold the spring against the upper brass washer 18*a* and apply a compressive force against the shale specimen, i.e., a force tending to flatten the pellet. This arrangement is useful in simulating pressures which may develop in the wellbore. Springs of different thicknesses can be used to vary the compressive force against the pellet, and the integrity of the specimen exposed to such pressure during the test can be observed. All other conditions of the test would be the same as described above.

The method and apparatus of this invention can be used at the well site to evaluate the reaction of a shale stratum being drilled to the particular drilling mud being used. Alternatively, the method and apparatus of this invention can be a valuable tool in the laboratory of researchers in studying the reaction of shales and other geological strata to experimental fluid formulations.

I claim:

1. A method for quantitatively measuring the physical integrity of geological strata after exposure to a liquid or mixture of liquids comprising the steps of:

(a) forming a test specimen of the stratum to be measured;

(b) immersing the specimen in the liquid for a predetermined length of time;

(c) spinning the test specimen about its vertical axis up to a predetermined speed while adjusting the temperature in a predetermined sequence; and (d) physically measuring the specimen for disintegration, liquid absorption, and hardness.

2. A method for simulating the environment experienced by geological strata during drilling and quantitatively measuring the physical integrity of said strata after exposure to a liquid or mixture of liquids comprising the steps of:

(a) forming a test specimen of the stratum to be measured;

(b) immersing the specimen in the liquid for a predetermined length of time;

(c) spinning the test specimen up to a speed of 1500 revolutions per minute while adjusting the temperature in a predetermined timed sequence; and (d) physically measuring the specimen for disintegration, liquid absorption, and hardness.

3. The method of claim 2 wherein the test specimen is formed by grinding the stratum into a fine powder and pressing 2 grams of the powder in a die of 0.2 square inch cross-section around the shank of a nail adjacent the head for 2 minutes at a pressure of 5000 psi.

4. The method of claim 2 or claim 3 wherein the specimen to be measured is humidity conditioned at a relative humidity in the range of 30% to 90% for at least 24 hours prior to immersion in the liquid.

5. The method of claim 2 or claim 3 wherein the temperature is held at room temperature for 15 minutes, raised to 80° C. for 30 minutes, and then returned to room temperature for 15 minutes while the test specimen is spinning.

6. The method of claim 2 or claim 3 wherein the disintegration is measured by determining the fraction of stratum lost from the original specimen due to sloughing during the test, and liquid absorption is measured by determining weight gain with concomittant swelling of the specimen.

7. The method of claim 3 wherein the test specimen is spun by securing the pointed end of the nail shank in a chuck and attaching the chuck to the shaft of a motor having a rotational speed controllable at 1500 revolutions per minute.

8. The method of claim 2 or claim 3 wherein the specimen is compressed between opposed parallel surfaces during spinning.

9. The method of claim 4 wherein the specimen is humidity conditioned at 84% relative humidity.

10. The method of claim 4 or claim 9 wherein the specimen to be measured is first retorted prior to humidity-conditioning.

11. An apparatus for simulating the environment experienced by geological strata during drilling which comprises:

(a) a cup for holding a drilling liquid;

(b) a liquid bath surrounding said cup for indirectly heating or cooling said drilling liquid;

(c) means for immersing a specimen in said drilling liquid which comprises a nail having the specimen attached to the shank adjacent the head inverted in said cup to hold the specimen below the surface of the drilling liquid; and (d) means for spinning said specimen at a predetermined speed while it is immersed.

12. The apparatus of claim 11 wherein said means for spinning said specimen comprises a chuck arranged vertically to receive and hold the nail shank near the point, and means for spinning the chuck while the specimen is held below the surface of the drilling liquid.

* * * * *